US005381569A

United States Patent [19]

Church

[11] Patent Number: 5,381,569

[45] Date of Patent: Jan. 17, 1995

[54] PATENT TURNING AND POSITIONING DEVICE AND METHOD

[76] Inventor: Bennett T. Church, 146 Dallas St., Nacogdoches, Tex. 75961

[21] Appl. No.: 181,391

[22] Filed: Jan. 13, 1994

[51] Int. Cl.[6] ..... A61G 7/053

[52] U.S. Cl. ..... 5/81.1; 108/139; 248/349

[58] Field of Search ..... 5/81.1, 630; 248/349; 108/139; D7/501

[56] References Cited

U.S. PATENT DOCUMENTS

| | | | |
|---|---|---|---|
| 1,334,901 | 3/1920 | Higdon . | |
| 2,192,821 | 3/1940 | Torines | 5/83 |
| 2,323,500 | 11/1941 | Trigg | 294/15 |
| 2,404,734 | 7/1946 | Lenahan | 5/86 |
| 3,052,894 | 11/1959 | Bigger | 5/81 |
| 3,962,736 | 6/1976 | Fedele | 5/81 |
| 4,034,947 | 7/1977 | Geisel | 248/349 |
| 4,944,053 | 7/1990 | Smith | 5/630 |
| 5,079,789 | 1/1992 | Jandrakovic | 5/81.1 |
| 5,282,284 | 2/1994 | Brantman et al. | 5/81.1 |

*Primary Examiner*—Alexander Grosz

*Attorney, Agent, or Firm*—Ross, Howison, Clapp & Korn

[57] ABSTRACT

A device for moving a patient in a bed includes a base member adapted to be supported by the bed. The device further includes a patient support member interconnected to and supported by the base member. The patient support member is rotatable with respect to the base member to enable movement of a patient between a supine position and a sitting position.

1 Claim, 2 Drawing Sheets

PATENT TURNING AND POSITIONING DEVICE AND METHOD

TECHNICAL FIELD OF THE INVENTION

The present invention relates to medical devices, and more particularly to a device for turning and positioning a patient in a bed.

BACKGROUND OF THE INVENTION

Patients confined to a bed may experience difficulty in moving in and out of the bed. In a hospital environment, many times only one nurse or aide is available to assist the patient in and out of bed. As is usually the case, in medical surgical situations, rehabilitation, or long term care situations, the patients can offer little or no help to move themselves. The patient's hips may be the total weight bearing joints to support the patient in moving from a supine to an upright sitting position at the edge of the bed. In the course of moving the patient, the patient basically is "dead" weight. The aide must bend over the bed to grasp the patient and lift, pull, and turn the patient from a mechanically unsound position. This movement may injure the patient as well as the aide.

A need has thus arisen for a device to assist in patient movement into and out of a bed whereby difficult movements and movements which may injure a patient are substantially eliminated.

SUMMARY OF THE INVENTION

In accordance with the present invention, a device for moving a patient in a bed is provided. The device includes a base member adapted to be supported by the bed. The device further includes a patient support member interconnected to and supported by the base member. The patient support member is rotatable with respect to the base member to enable movement of a patient between a supine position and a sitting position.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
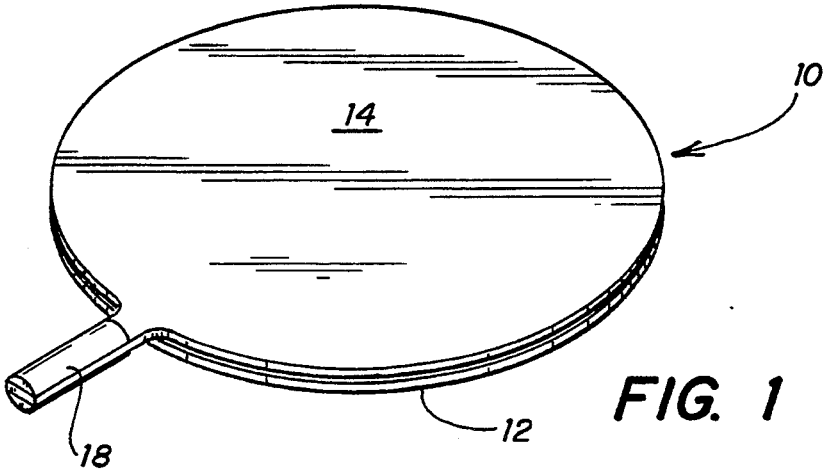
FIG. 1 is a perspective view of the present patient turning and positioning device.
Figure 2:
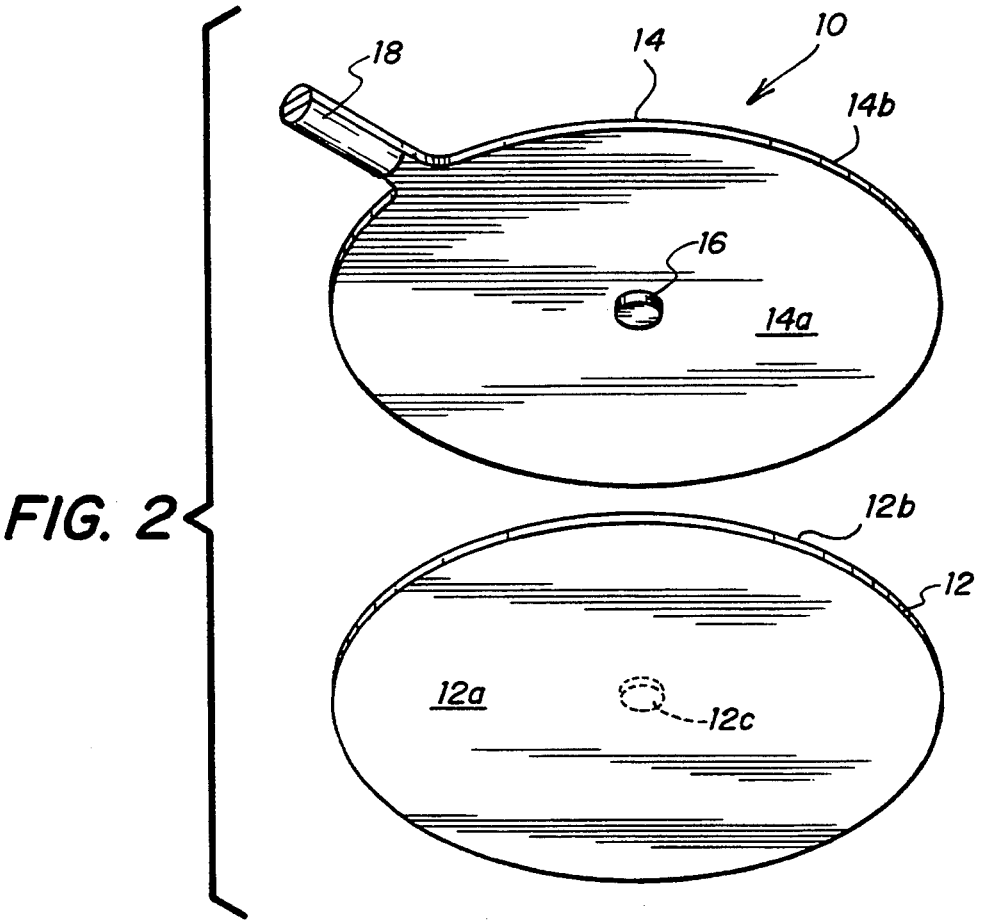
FIG. 2 is an exploded perspective view of the present device.

Referring simultaneously to FIGS. 1 and 2, the present patient turning and positioning device is illustrated, and is generally identified by the numeral 10. Patient turning and positioning device 10 includes a circular base member 12 which is adapted to be positioned, and supported by a bed. Base member 12 includes a bottom surface 12*a* and a top surface 12*b*. Centrally disposed within base member 12 is an aperture 12*c*.

Patient turning and positioning device 10 further includes a patient support member 14, which is generally circular in shape and is positioned to lie adjacent to base member 12. Patient support member 14 includes a bottom surface 14*a* and a top surface 14*b*. Centrally disposed in bottom surface 14*a* of patient support member 14 is a spindle 16 which engages aperture 12*c* of base member 12. Patient support member 14 is rotatable with respect to base member 12 over 360 degrees range of motion through the interconnection of spindle 16 within aperture 12*c*. Bottom surface 14*a* of patient support member 14 and/or top member 12*b* of base member 12 may include a low friction coating to assist in the rotation ability of patient support member 14 with respect to base member 12. Interconnected to patient support member 14 is a handle 18 to further assist in the rotation of patient support member 14.

Figure 3:
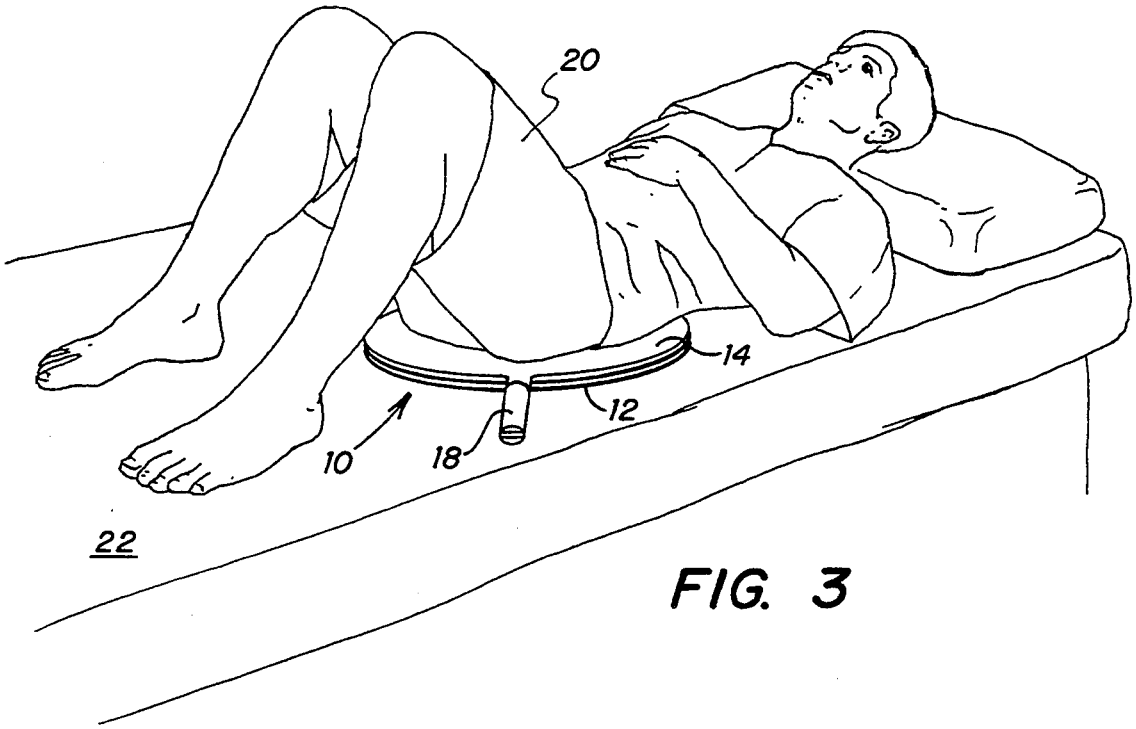
FIG. 3 is a perspective view of a patient positioned in the supine position in a bed utilizing the present device.
Figure 4:
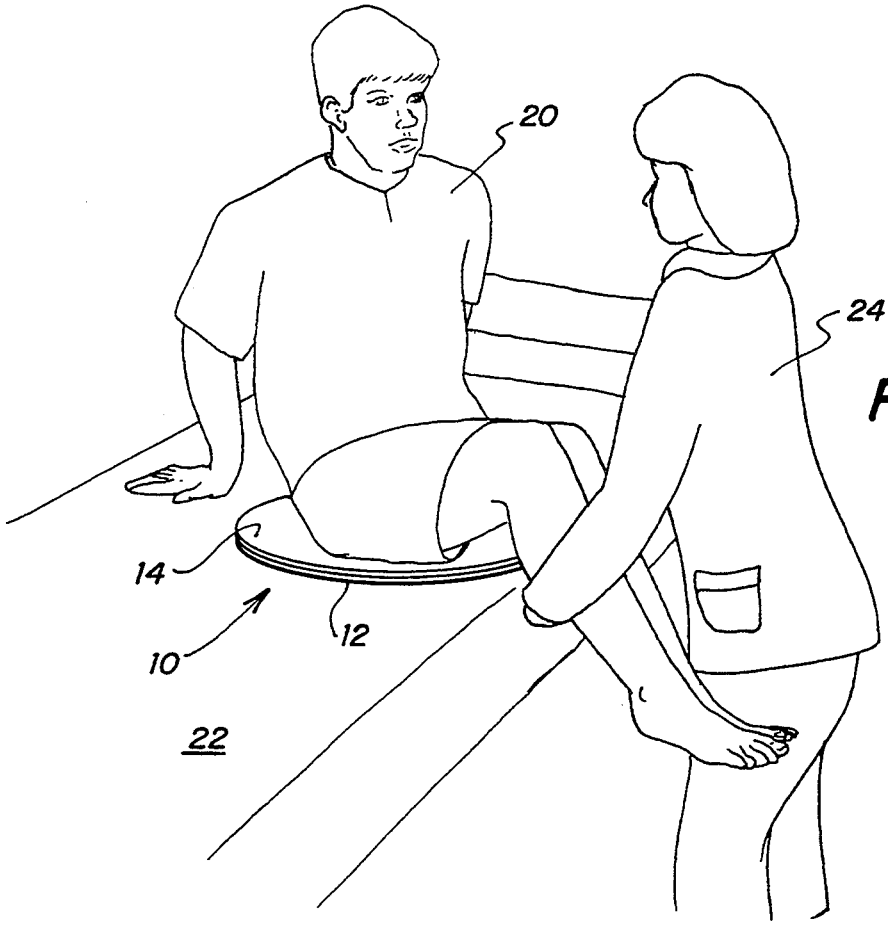
FIG. 4 is a perspective view of a patient in a bed in an upright, sitting position utilizing the present device.

The operation of the present device 10 will now be described with respect to FIGS. 3 and 4. A patient 20 is shown in FIG. 3 lying in a supine position in a bed 22. Device 10 is disposed under the hips of patient 20, the hips being extended about one inch or the patient 20 is turned to the side to enable hip extension in order to place device 10 under the hips of patient 20. As illustrated in FIG. 4, patient 20 is moved from a supine position to a sitting position with legs outstretched. Patient 20 is supported by one or both hands placed behind the buttocks. An aide 24 grasps the legs of patient 20, between the ankle and calf with one arm and grasps handle 18 of device 10 with the free hand. In one motion, aide 24 rotates member 14 approximately 90 degrees in the appropriate direction, and patient 20, sitting on device 10, is easily turned into the sitting position at the edge of bed 22 as shown in FIG. 4. The feet of patient 20 are directed towards the floor, ready for a next step in transfer from bed 22. Any discomfort to patient 20 is eliminated, and neither bed linen, incontinence pads, or the clothing of patient 20 is twisted, knotted, or pulled out of place as member 14 is rotated. No awkward positioning is required by the aide 24, and any injury to aide 24 is minimized through the use of device 10.

In order to reposition patient 20 from a sitting position to the supine position, the reverse process is utilized. The patient is seated on device 10, member 14 is rotated in the opposite direction for a range of 90 degrees in order to reposition the patient to a supine position as illustrated in FIG. 3.

It therefore can be seen that the present device performs the function to assist movement of a patient into and out of a bed between a supine and a sitting position. The present device provides for the patient to be rotated approximately 90 degrees without lifting, pulling, or turning a patient from a mechanically unsound position.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A method for moving a patient from a lying position on a bed to a sitting position on a bed comprising the steps of:

providing a base member and a support member, the support member being interconnected to the base member and being rotatable with respect to the base member;

providing a handle connected to the support member;

providing a low friction surface between the base member and the support member;

placing the support member under the hips of a patient with the base member supported by a bed while a patient is in a lying position on a bed; supporting a patient's upper body portion in an elevated position relative to bed, and rotating the support member with respect to the base member using the handle, and moving a patient's legs off the surface of a bed, thereby moving a patient from a lying position to a sitting position on a bed.

* * * * *